United States Patent [19]

Erlandson

[11] 4,183,441

[45] Jan. 15, 1980

[54] CONTAINER FOR PRESSURIZED PRODUCTS HAVING A SECURITY LABEL

[75] Inventor: Paul M. Erlandson, Palos Park, Ill.

[73] Assignee: The Continental Group, Inc., New York, N.Y.

[21] Appl. No.: 923,886

[22] Filed: Jul. 12, 1978

[51] Int. Cl.[2] ..... B65D 11/16

[52] U.S. Cl. ..... 215/12 R; 215/307; 206/430; 206/432; 40/310; 215/100 R

[58] Field of Search ..... 206/430, 432; 264/230, 264/509; 215/12 R, 1 C, 307, 100 R; 40/310

[56] References Cited

U.S. PATENT DOCUMENTS

| | | | |
|---|---|---|---|
| 735,707 | 8/1903 | Cantwell | 215/11 R |
| 779,749 | 1/1905 | Tinling | 215/11 R |
| 951,419 | 3/1910 | Eberley | 215/11 R |
| 1,982,814 | 12/1934 | Bissell | 215/12 R |
| 2,745,642 | 5/1956 | Hermann | 215/1 C |
| 3,342,365 | 9/1967 | Lux | 215/1 C |
| 4,018,640 | 4/1977 | Amberg | 264/230 |

FOREIGN PATENT DOCUMENTS

| | | | |
|---|---|---|---|
| 263627 | 11/1912 | Fed. Rep. of Germany | 215/11 R |
| 340126 | 7/1904 | France | 215/11 R |
| 1054716 | 2/1954 | France | 215/12 R |
| 754586 | 3/1955 | France | 215/12 R |
| 1099267 | 9/1955 | France | 215/12 R |
| 550076 | 10/1956 | Italy | 215/1 C |

*Primary Examiner*—Ro E. Hart

*Attorney, Agent, or Firm*—Charles E. Brown

[57] ABSTRACT

A container for pressurized products wherein the container is formed of first and second container halves joined in a generally mid-height peripheral seam. Under abusive handling, the seam could open and a rupture type failure may occur. A shrunk plastics material film wrapper is applied along the central portion of the container in overlying relation to the peripheral seam and serves to permit controlled venting of the pressure from within the container in the event of such seam failure of the container per se.

7 Claims, 2 Drawing Figures

CONTAINER FOR PRESSURIZED PRODUCTS HAVING A SECURITY LABEL

This invention relates in general to new and useful improvements in containers, and more specifically to a novel container for pressurized products such as beverages.

A new development in the packaging of beverages is a high demand for larger containers of a size on the order of two liters and larger. It has been proposed to form such containers of two container halves which may be readily formed and wherein the two container halves are joined by a single peripheral seam disposed generally mid-height of the container. Such peripheral seam is most easily formed by merely telescoping free ends of the container halves and bonding the overlapped container half portions together. The resultant seam is more than adequate to maintain the internal pressure. However, it will be apparent that when such a container is struck or is dropped so as to strike some surface under abnormal conditions, there could be rupture type failure of the container in the peripheral seam area.

This invention particularly relates to a solution of the rupture type failure possibility by covering the peripheral seam in such a manner wherein when abnormal failure does occur, instead of there being an immediate blowout of the contents of the container, the container contents will be normally retained within the container and the pressure gradually vented with a minimum spillage of the beverage or other liquid packaged under pressure.

Most particularly, the means for preventing blowout and effecting controlled venting is in the form of a band or sleeve of plastics material film shrunk in place about the container. The sleeve will expand under pressure and effect a controlled venting of the interior of the container in the event of seam failure.

The sleeve may have a second and advantageous function in that the sleeve may be in the form of a label, thereby eliminating either the provision of a separate label or decoration of the container.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
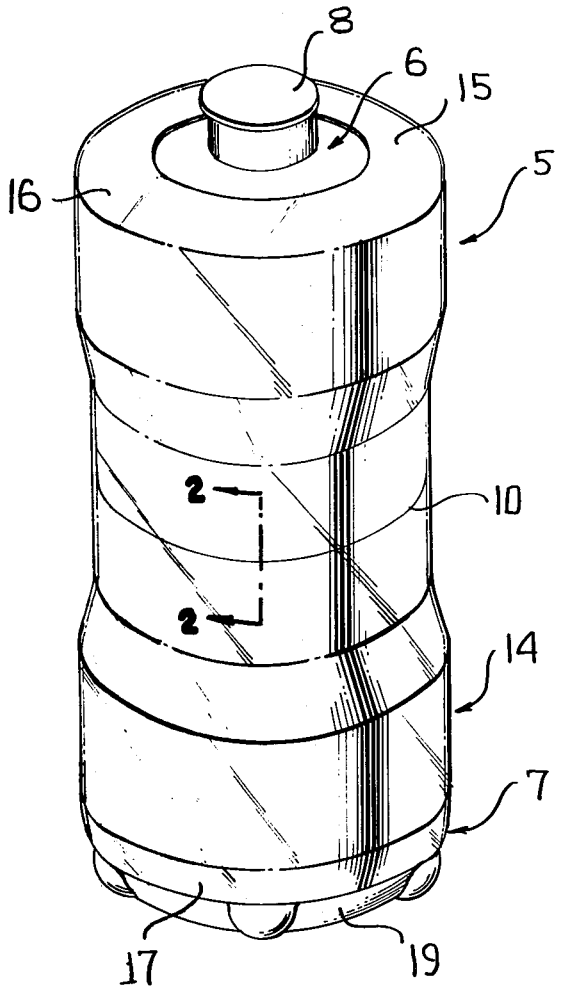
FIG. 1 is a perspective view of a container formed in accordance with this invention.

Referring now to the drawings in detail, it will be seen that there is illustrated in FIG. 1 a container formed in accordance with this invention, the container being generally identified by the numeral 5. The container is simply formed of two container halves 6 and 7, each of which is of a cup-shaped configuration and may be readily formed. The container half 6 is disposed uppermost and is provided with a suitable dispensing fitting 8. The container half 7 has a bottom construction 9 which is of a configuration to resist the internal pressure within the container 5 and still provide an adequate supporting base. The general configuration of the container 5 is not a part of this invention.

Figure 2:
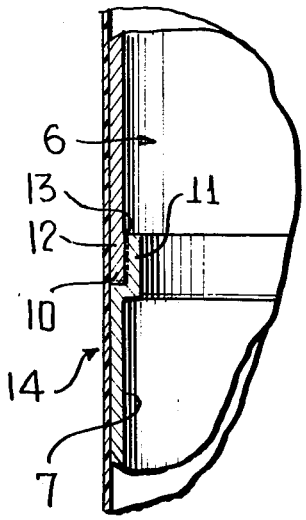
FIG. 2 is an enlarged fragmentary vertical sectional view taken along the line 2—2 of FIG. 1, and shows the details of the container peripheral seam and the security label overlying the same.

Referring now to FIG. 2, it will be seen that the container half 6 is joined to the container half 7 by a peripheral seam 10. The peripheral seam 10 is of a simple construction and includes an end portion 11 of the container half 7 telescoped within an end portion 12 of the container half 6. A suitable bonding material 13 seals the container portions 11 and 12 against leakage and separation due to high internal pressures.

It is to be understood that the container halves 6, 7 may be formed of suitable materials which cannot be secured together in a conventional manner such as by welding or by soldering, and accordingly the bonding material could be a suitable adhesive.

It is to be understood that the peripheral seam 10 is more than adequate to prevent separation of the container halves 6, 7 due to internal pressures within the container 5, it being the intended use of the container 5 to package liquids, preferably beverages, under high internal pressures. The internal pressures under certain conditions may exceed 100 p.s.i. Further, the peripheral seam 10 is of a construction normally to be shock resistant in the event of droppage of the container or other rough handling. On the other hand, it will be apparent that should the container 5 be unduly abused, there could be a blowout failure. Normally the failure will be by way of rupture of the seam 10 only sufficient to effect rapid expulsion of the packaged product. On the other hand, the failure of the seam 10 could be effected to the extent that the two container halves 6, 7 would separate and suddenly release the contents of the container.

In accordance with this invention, it is proposed to provide the container 5 with a label, generally identified by the numeral 14, which will have dual functions. The label 14 will, of course, carry suitable indicia to serve its function as a label. Secondly, the label 14 will be formed of a heat shrinkable plastics material film which may be readily shrunk into place with the film having sufficient strength to prevent rupture upon failure of the seam 10.

It is to be noted that the label 14 is in the form of an elongated sleeve and has an upper end portion 15 which engages around a corresponding upper end portion 16 of the container half 6. In a like manner, the label 14 will have a lower end portion 18 which engages peripherally around the bottom configuration 9. Thus, the label 14 is both generally tightly sealed with respect to the exterior of the container 5 and is interlocked with the upper ends of the container 5 in a manner to resist separation of the container halves 6, 7.

In the event the pressurized container 5 is damaged to the extent that there is any peripheral rupture of the seam 10, the label 14 will serve to prevent an immediate venting of the contents to the atmosphere and will function as a valve to allow the gradual venting of the container. On the other hand, should the rupture of the seam 10 be to the extent that the container halves 6, 7 begin to separate at the seam 10, the anchoring of the opposite ends of the label 14 to the container halves 6, 7 will prevent immediate separation of the container halves and will also function as a valve to vent the pressure from within the container, thereby eliminating the force which would effect separation of the container halves.

It is to be understood that the label 14 may be provided as a pre-printed sleeve which may be readily telescoped over the container 5 and then heat shrunk in place in a conventional manner. If added strength is desired, the sleeve may be of a seamless construction.

Although only a preferred embodiment of the container has been specifically illustrated and described herein, it is to be understood that minor variations may be made in the container without departing from the spirit and scope of the invention as defined by the appended claims.

I claim:

1. A new article of manufacture comprising a container for pressurized products, said container including first and second container halves joined in a generally mid-height pressure resistant peripheral seam, and means for controlling the venting of said container in the event of rupture along said seam, said vent means including a label completely encircling said container in overlying relation to said peripheral seam and being tightly secured to said container halves above and below said peripheral seam, said label being formed of a pressure resistant material.

2. A container according to claim 1 wherein said label is in the form of a seamless sleeve.

3. A container according to claim 1 wherein said label is formed of a plastics material film and is heat shrunk in situ.

4. A container according to claim 3 wherein said label is in the form of a sleeve.

5. A container according to claim 1 wherein said peripheral seam is defined by telescoped portions of said container halves bonded together.

6. A container according to claim 5 wherein said label is formed of a plastics material film and is heat shrunk in situ.

7. The container of claim 1 wherein said container halves have oppositely remotely facing end portions and said label engage said end portions and restraining said container halves against axial separation.

* * * * *